US005971384A

United States Patent [19]

Asao

[11] Patent Number: 5,971,384

[45] Date of Patent: Oct. 26, 1999

[54] FINISHING APPARATUS AND IMAGE FORMING APPARATUS USING THE SAME

[75] Inventor: Yuusuke Asao, Yamanashi-ken, Japan

[73] Assignee: Nisca Corporation, Yamanashi, Japan

[21] Appl. No.: 09/048,895

[22] Filed: Mar. 27, 1998

[30] Foreign Application Priority Data

Mar. 31, 1997 [JP] Japan ..... 9-097958

[51] Int. Cl.[6] ..... B65H 33/04; G03G 15/20; G03G 15/00

[52] U.S. Cl. ..... 270/58.13; 270/58.01; 270/58.07; 270/58.09; 270/58.14; 399/410; 399/124

[58] Field of Search ..... 270/58.08, 58.13, 270/58.01, 58.07, 58.09, 58.14; 271/273, 264; 399/410, 124, 19, 20, 21

[56] References Cited

U.S. PATENT DOCUMENTS 5,137,265 8/1992 Sato et al. .
5,161,724 11/1992 Redtke et al. ..... 227/1
5,481,354 1/1996 Nakajima ..... 355/324
5,737,987 4/1998 Olson et al. ..... 271/213 X
5,826,158 10/1998 Hirano et al. ..... 399/410

*Primary Examiner*—William E. Terrell
*Assistant Examiner*—Kenneth W. Bower
*Attorney, Agent, or Firm*—Kanesaka & Takeuchi

[57] ABSTRACT

A finishing device of the present invention is formed of a piling tray disposed above a main image forming device to hold a sheet therefrom, a stapling tray for temporally piling the sheet transferred from the main image forming device to the piling tray and a stapling device for binding a stack of sheets on the stapling tray. The finishing device further includes a first sheet transferring path for guiding the sheet from the main image forming device in a substantially vertical direction; a second sheet transferring path having a deflecting portion connected to the first sheet transferring path to guide the sheet in a substantially horizontal direction. The stapling tray extends from an exit terminal of the second sheet transferring path; the piling tray holds the sheet from the stapling tray; and the stapling device is disposed between the deflecting portion of the second sheet transferring path and the stapling tray to bind the rear ends of the sheets on the stapling tray in an ejecting direction. Thus, the entire installation area of an image forming apparatus is reduced, and at the same time, the whole apparatus can be made compact.

9 Claims, 5 Drawing Sheets

FINISHING APPARATUS AND IMAGE FORMING APPARATUS USING THE SAME

BACKGROUND OF THE INVENTION AND RELATED ART STATEMENT

The present invention relates to an image forming apparatus, such as a copier or printer, more particularly a finishing device for temporally piling, on a stapling tray, a plurality of image formed sheets ejected from a main image forming device and holding them on a piling tray after the rear ends in an ejecting direction of the sheets are bound by a stapler, and an image forming apparatus using thereof.

Heretofore, there has been widely known an image forming apparatus wherein a finishing device is horizontally connected to a main image forming device of a copying machine, printer or the like, so that an image forming process and a finishing process are sequentially disposed in parallel to thereby pile the processed sheets on a sheet ejecting stacker.

In such an apparatus, since the main image forming device and the finishing device are connected in a horizontal direction, a wide area for installing the whole apparatus is required. Also, a sheet ejecting stacker is projected from a side surface of the main image forming device opposite to a side surface connected to the finishing device, and a sheet ejecting stacker is projected from a side surface of the finishing device opposite to a side surface connected to the main image forming device, so that a considerably wide area for installing the apparatus is required.

It is an object of the present invention to provide a finishing device wherein an area for installing a whole image forming apparatus can be reduced and the whole image forming apparatus can be structured to be compact, and an image forming apparatus using the same.

SUMMARY OF THE INVENTION

In order to solve the above problems, a finishing device according to a first aspect of the present invention formed of a piling tray situated above a main image forming device to pile the sheets therefrom, a stapling tray for temporally holding the sheets transferred from the main image forming device to the piling tray, and a stapling device for binding a stack of sheets on the stapling tray includes: a first sheet transferring path for guiding a sheet in a substantially vertical direction from the main image forming device; a second sheet transferring path having a deflecting portion, connected to the first sheet transferring path, for guiding the sheet in a substantially horizontal direction; the stapling tray extending from an exit terminal of the second sheet transferring path; the piling tray for piling the sheets from the stapling tray; and a stapling device disposed between the deflecting portion of the second sheet transferring path and the stapling tray to thereby bind rear edges of the sheets on the stapling tray in a sheet ejecting direction.

Also, an image forming apparatus according to a second aspect of the present invention formed of a sheet feeding stacker for holding sheets, an image forming device for forming an image on a sheet from the sheet feeding stacker, a stapling tray for temporally piling the sheets from the image forming device, a stapling device for binding the sheets on the stapling tray, and a piling tray for successively piling stacks of the sheets on the stapling tray includes: the sheet feeding stacker disposed at a bottom portion of the device in a substantially horizontal direction; a sheet feeding path for transferring, in a substantially vertical direction, the sheet from the sheet feeding stacker by deflecting in a substantially perpendicular direction thereto; the image forming device disposed in the sheet feeding path; a first sheet transferring path for guiding, upward in the substantially vertical direction, the sheet from the image forming device; a deflecting portion formed in the first sheet transferring path to deflect the sheet in the substantially horizontal direction; the stapling tray for temporally piling the sheets from the deflecting portion; the piling tray for piling and holding the stack of sheets from the stapling tray; and the stapling device located between the deflecting portion or the first sheet transferring path and the stapling tray.

DETAILED DESCRIPTION OF PREFERRED EMBODIMENT

Next, an embodiment of a sheet ejecting device of the present invention applied to a finishing device installed on an upper surface of an image forming device is described referring to the accompanying drawings.

Figure 5:
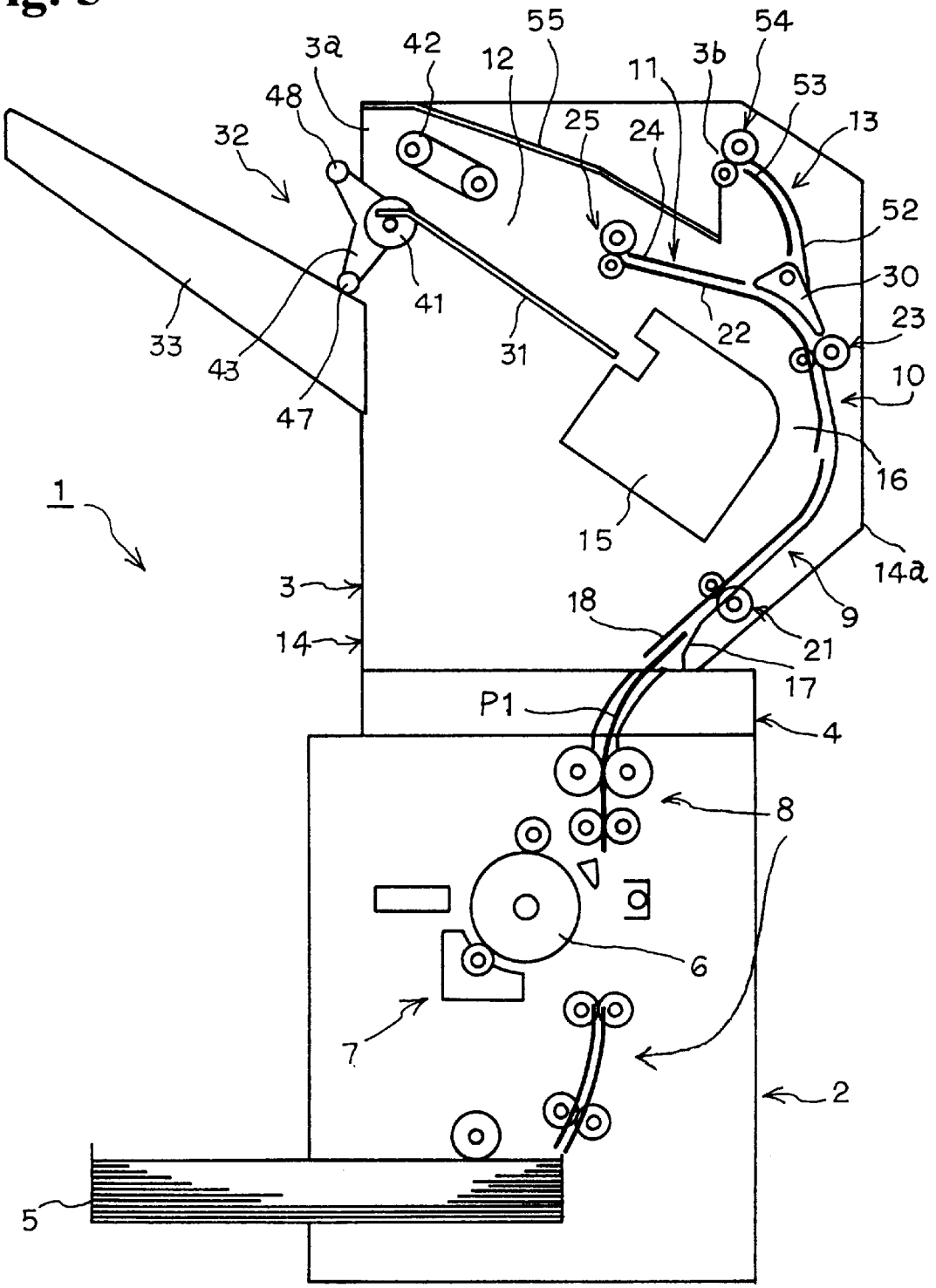
FIG. 5 is a diagrammatic section view of an image forming apparatus.

In FIG. 5, an image forming apparatus 1 includes a main image forming device 2, such as a copying machine and laser printer, a finishing device 3 installed on the main image forming device 2, and an adaptor device 4 for connecting the main image forming device 2 and the finishing device 3.

The main image forming device 2 includes a sheet-feeding cartridge 5 for accommodating therein a plurality of sheets; an image forming device 7 having a transfer-printing drum 6 for transfer printing an image on a sheet transferred through a sheet feeding path 8 from the sheet-feeding cartridge 5; and the sheet feeding path 8 for feeding the sheet on which the image has been set, to the finishing device 3. A sheet P1 sent out from the sheet feeding path 8 is fed to the finishing device 3 through the adaptor device 4. The adaptor device 4 is inserted between the finishing device 3 and the main image forming device 2 to adjust the finishing device 3 to various kinds of image forming devices.

Incidentally, it is also possible to form an image forming apparatus wherein functions of the finishing device 3, which are described later, are built in the main image forming device 2 so that the main image forming device 2 and the finishing device 3 are included in one device.

The finishing device 3 is communicated with the main image forming device 2 through the adaptor device 4, and includes a second deflecting path 9 for deflecting the sheet P1 transferred upward from the main image forming device 2; a first sheet transferring path 10 for guiding the sheet from the second deflecting path 9 in a substantially vertical direction; a second sheet transferring path 11 having a deflecting portion for guiding the sheet from the first sheet transferring path 10 in a substantially horizontal direction; a processing space 12, also used as a sheet ejecting path, formed between an exit terminal on a sheet ejecting downstream side and a sheet ejecting port 3*a* of the finishing device 3; and a second sheet ejecting path 13 (a third deflecting portion) branched from a border portion between the first sheet transferring path 10 and the second sheet transferring path 11 having the deflecting portion.

More specifically, the finishing device 3 includes a staple processing path wherein after the sheet P1 passes through the second deflecting path 9, the first sheet transferring path 10, and the second sheet transferring path 11 having the deflecting portion to be guided to the processing space 12, the sheet P1 is guided to the sheet ejecting port 3*a*; a non-processing path wherein after the sheet P1 passes through the second deflecting path 9, the first sheet transferring path 10 and the second sheet transferring path 11 having the deflecting portion, the sheet P1 passes through the processing space 12 to be guided to the sheet ejecting port 3*a*; and a non-processing path wherein the sheet P1 passes through the second deflecting path 9, the first sheet transferring path 10 and the second sheet ejecting path 13 (a third deflecting portion). Also, the second deflecting path 9, the first sheet transferring path 10 and the second sheet transferring path 11 having the deflecting portion form an accommodating space 16 for installing a stapling device 15 therein by detouring the whole paths along a rear shape of a housing 14 of the finishing device 3 in a substantially U-character shape.

Figure 1:
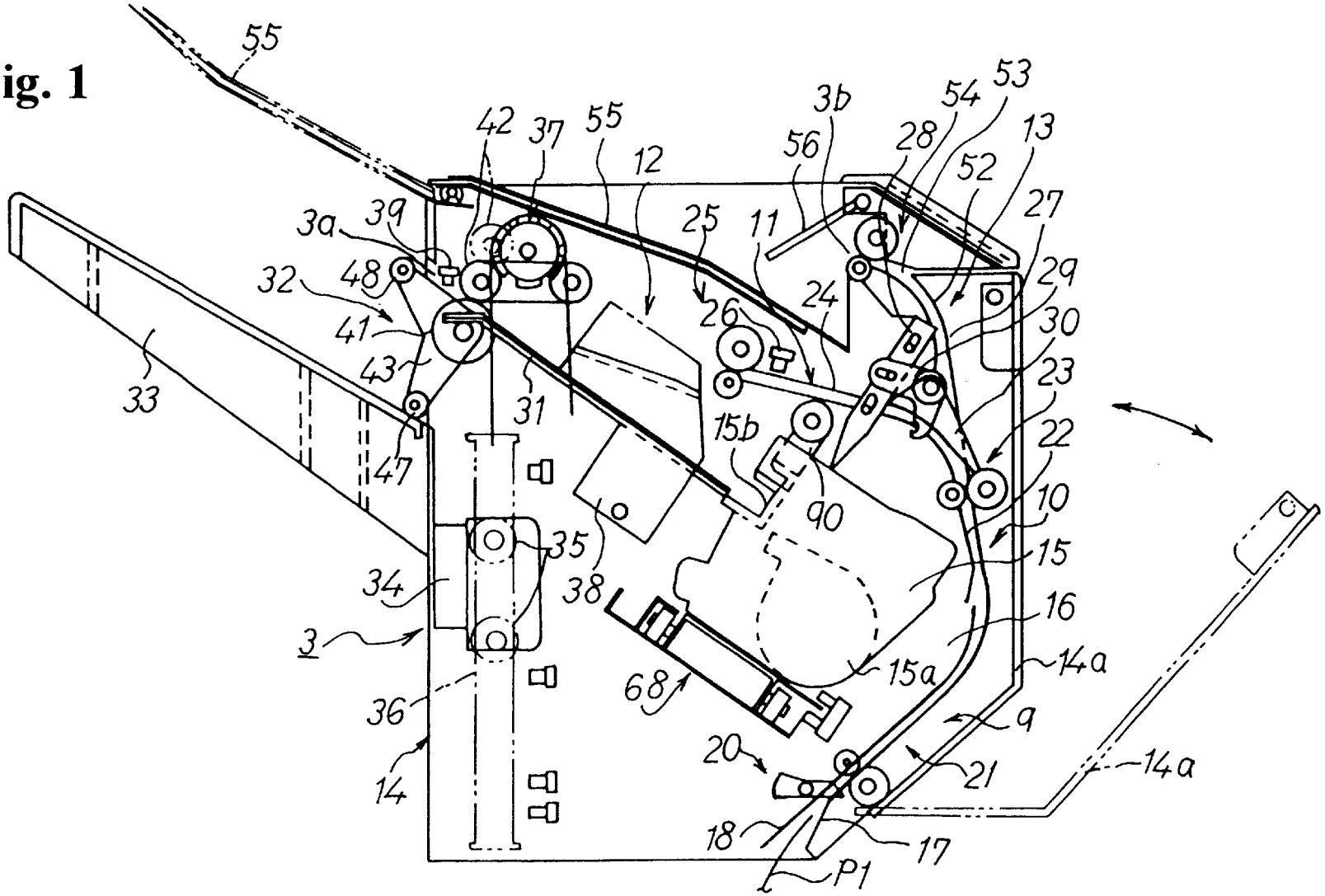
FIG. 1 is a vertical section view showing an essential part of a finishing device according to the present invention.
Figure 2:
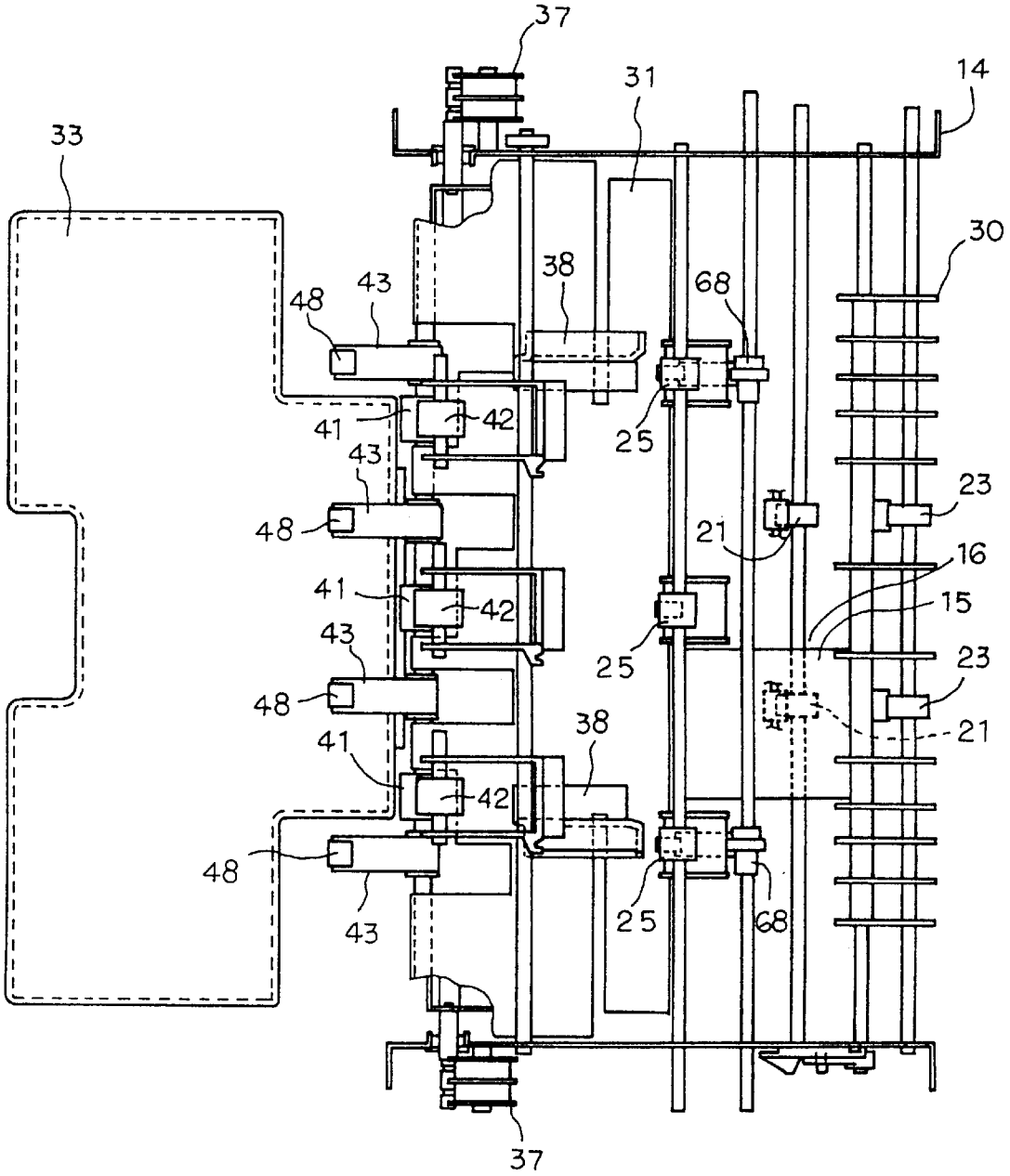
FIG. 2 is a plan view of the essential part of the finishing device.

The second deflecting path 9 is formed of a pair of opposed guide plates 17, 18 with a space therebetween so that the sheet P1 can pass therethrough. Also, at a starting edge portion of the second deflecting path 9, as shown in FIG. 1, there are provided a sheet detecting sensor 20 for detecting forward and rear ends of the sheet P1 transferred from the adaptor device 4; and a pair of sheet feeding rollers 21, 21 provided at two portions in a width direction (refer to FIG. 2) of the sheet P1 so that the sheet P1 can be transferred on a downstream side of the second deflecting path 9.

The first sheet transferring path 10 is formed of a guide plate 22 opposed to the guide plate 17 with a space therebetween so that the sheet can pass therethrough. Also, the first sheet transferring path 10 is provided, in the middle portion thereof, with a pair of transferring rollers 23, 23 for transferring the sheet from the second deflecting path 9 on the downstream side in the transferring direction.

The second sheet transferring path 11 having the deflecting portion is formed of a guide plate 24 opposed to the guide plate 22 with a space therebetween so that the sheet can pass therethrough. Also, at a path terminal portion of the second sheet transferring path 11 having the deflecting portion there are provided plural pairs of transferring rollers 25, 25, 25 for transferring the sheet from the first sheet transferring path 10 to a downstream side in an ejecting direction; and a sheet detecting sensor 26 for detecting the forward and rear ends of the sheet to be ejected from the second sheet transferring path 11 having the deflecting portion. Also, at a border portion between the first sheet transferring path 10 and the second sheet transferring path 11 having the deflecting portion there is provided a switching device 27 for switching a transferring direction of the sheet to either the second sheet transferring path 11 having deflecting portion or the second sheet ejecting path 13 (the third deflecting portion).

After the sheet detecting sensor 20 counts the number of transfer printing sheets set on a control panel or computer side of the main image forming device 2, when the sheet detecting sensor 26 detects rear ends of the sheets to be ejected corresponding to the number of the detected count-up sheets, a command signal for driving the stapling device 15 is outputted after a predetermined time passes.

In the present embodiment, there is shown an example wherein the finishing device 3 itself determines a timing for stapling process based on information from the sheet detecting sensor 20 to thereby drive the stapling device 15. However, naturally, there may be considered a system wherein the image forming device 2 itself knows the timing, and sheet number counting and stapling process decision are also carried out in the image forming device 2 itself to thereby output a stapling command to the finishing device 3. Further, a signal for driving the stapling device 15 may be produced by a manually operated button or the like (not shown).

The switching device 27 includes crank arms 28, 29 driven in contraposition with movement of the stapling device 15 along a width direction of the sheet, and a switching lever 30 rotated by the movement of the crank arms 28, 29.

The processing space 12 is located under an exit terminal of the second sheet transferring path 11 having the deflecting portion, and formed over a stapling tray 31 obliquely extending toward the sheet ejecting port 3*a* from its lower end overlapping the exit terminal of the second sheet transferring path 11 having the deflecting portion. Also, in the vicinity of the sheet ejecting port 3*a* of the processing space 12 there is provided a sheet ejecting portion 32.

Also, under the sheet ejecting portion 32 there is provided a piling tray 33 projecting upward from an outer wall of the housing 14 in an inclined state. The piling tray 33 is vertically moved through vertical movement of rollers 35, 35 provided to a bracket 34 fixed to a base portion of the piling tray 33 along a vertically extending guardrail 36, and an elevating device 37 for the vertical movement is provided at an outer portion of the housing 14.

The stapling tray 31 is provided with a pair of guides 38, 38 for aligning both sides of the sheets from the second sheet transferring path 11, and at least one of the pair of guides can be displaced in a sheet width direction according to a size of the sheet. Also, the stapling device 15 is accommodated in the accommodating space 16 formed to make a detour along the second deflecting path 9, the first sheet transferring path 10 and the second sheet transferring path 11 having the deflecting portion so that the stapling device 15 is positioned between the lower end of the stapling tray 31 and the first sheet transferring path 10. Further, the stapling tray 31 is provided with a measuring sensor 39 for detecting a sheet loading capacity. Incidentally, the detecting capacity of the measuring sensor 39 is set according to a permissible limit to be bound by the stapling device 15, and when sheets are piled over the permissible limit, no staple binding is carried out. Also, at the lower edge of the stapling tray 31, as shown in FIG. 3, there is provided a paddle 40.

The paddle 40 is rotated (counterclockwise in FIG. 3) when it is confirmed that a predetermined time has passed after the sheet detecting sensor 26 detects passage of the sheet, and the rotation of the paddle 40 drops the sheet so that the sheet ejected on the stapling tray 31 and slid down by its own weight toward the stapling device 15 positively abuts against a stopper 90 and a staple controlling wall 15*b* to thereby align the rear end of the sheet.

The sheet ejecting portion 32 includes a plurality of sheet eject driving rollers 41 rotatably provided to an upper end of the stapling tray 31, a plurality of arm-type driven rollers 42 provided to contact and separate with respect to the sheet eject driving rollers 41, and rotation arms 43 coaxially provided with the sheet eject driving rollers 41.

Figure 3:
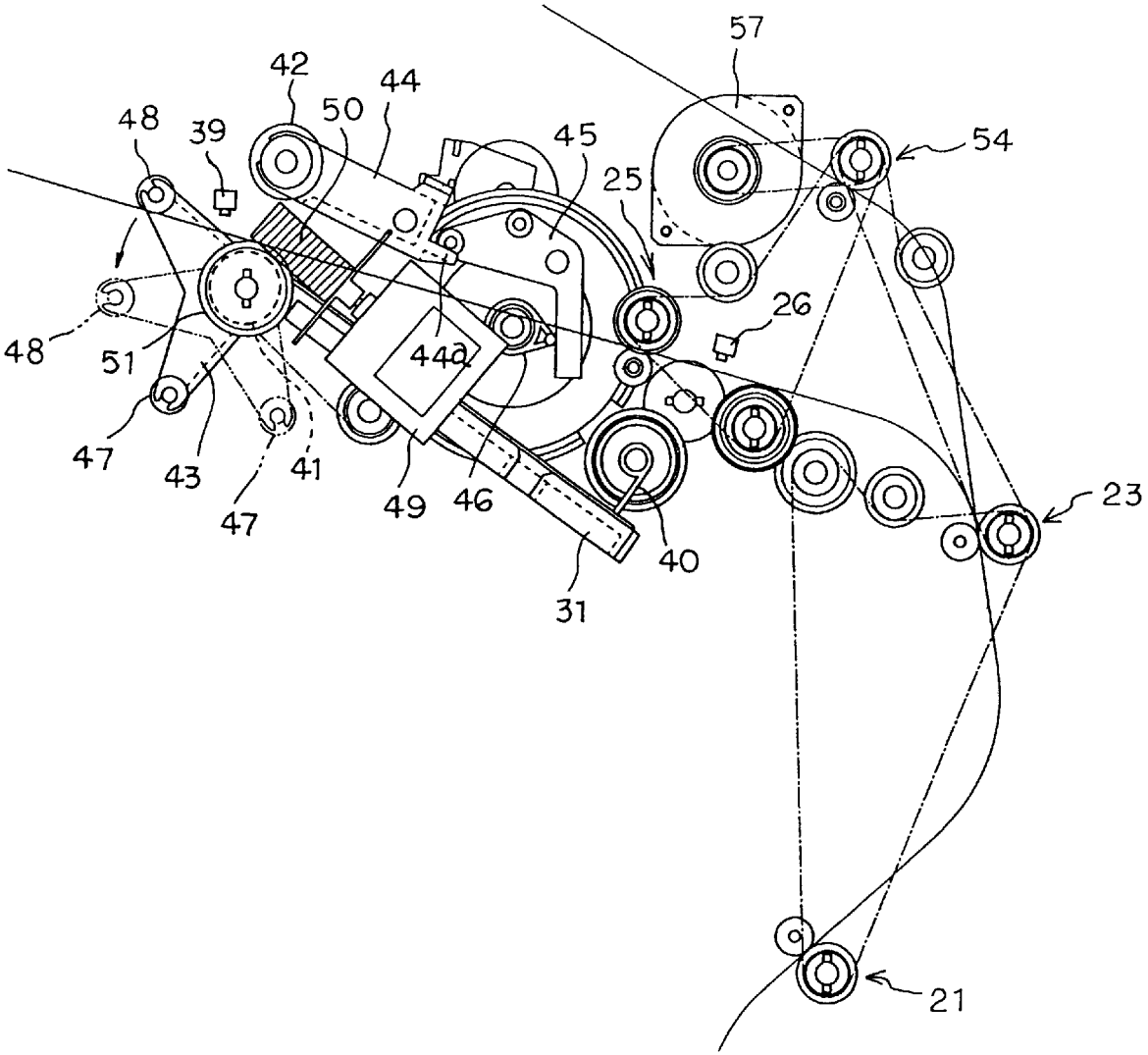
FIG. 3 is an enlarged side view of a sheet ejecting portion of the finishing device.

The arm-type driven rollers 42 approach (the state as shown in FIG. 1) or separate (the state as shown in FIG. 3), with respect to the sheet eject driving rollers 41 according to the ejecting state of the sheet. When the sheets are bound by the stapling device 15, the arm-type driven rollers 42 approach the sheet eject driving rollers 41 to sandwich a stack of sheets therebetween and to eject the stack of the sheets from the sheet ejecting port 3*a* onto the piling tray 33. Incidentally, the approach and separation of the arm-type driven rollers 42 are carried out in such a manner that, as shown in FIG. 3, an engaging pawl 44*a* is projectively provided to an arm 44 rotatably holding the arm-type driven rollers 42, one end of an L-character shape lever 45 is engaged with the engaging pawl 44*a* and an eccentric cam 46 abuts against the other end side of the lever 45, and control of the rotation of the eccentric cam 46 15 made. In other words, the L-character shape lever 45 is rotated according to a rotation angle of the eccentric cam 46 to thereby vertically move the engaging pawl 44*a*, and through the vertical movement of the engaging pawl 44*a*, the arm 44 is rotated.

The rotation arm 43 has a substantially L-character shape provided with rotatable rollers 47, 48 on both edges thereof. The rotation arm 43 is rotated such that a worm gear 50 is rotated through driving of a motor 49, and a rotation gear 51 receives rotation of the worm gear 50 to thereby rotate the rotation arm 43. Incidentally, although the sheet eject driving roller 41 and the rotation gear 51 are coaxially provided, they are rotated independently.

The second sheet ejecting path 13 is formed of opposed guide plates 52, 53 with a space therebetween so that the sheet can pass therethrough. Also, at a path terminal portion of the processing space 12 there are provided a pair of sheet ejecting rollers 54 for ejecting the sheet through an auxiliary sheet ejecting port 3*b*; and a loading capacity detecting sensor 56 for detecting a loading capacity of the sheets piled on an auxiliary piling tray 55 provided to be opened and closed at an upper portion of the housing 14 extending upward, in an inclined state, from a lower portion of the auxiliary sheet ejecting port 3*b*.

To the second sheet ejecting path 13 the sheet is supplied from a terminal portion of the first sheet transferring path 10 through switching of the sheet transferring path by the switching lever 30 since the crank arms 28, 29 are actuated in association with shift of the stapling device 15 as the stapling device 15 is shifted to its home position when it is not used.

When the loading capacity detecting sensor 56 detects a maximum loading capacity, it actuates the switching lever 30 so that the remaining sheets are piled on the piling tray 33. Incidentally, when the stapling device 15 is not used the sheets may be piled on the piling tray 33, and when a piling capacity on the piling tray 33 becomes maximum, the auxiliary piling tray 55 may be used.

The auxiliary piling tray 55 is rotatably provided to the housing 14 so that an upper portion of the stapling tray 31 can be exposed. Incidentally, the sensors 26, 39 also function as sheet-jam detecting sensors. In case the sensors 26, 39 detect a sheet jam, the auxiliary piling tray 55 is opened to thereby release the sheet jam. Incidentally, sheet jams in the second deflecting path 9 and the first sheet transferring path 10 can be detected by the sheet detecting sensor 20, and the sheet jams can be released by opening a cover 14*a*.

Further, in case the auxiliary piling tray 55 is provided with a supporting member, such as a wire, to a position as shown by the single-dotted chain lines in FIG. 1, the auxiliary piling tray 55 may be used to receive ejected sheets of a large size which can not be processed by the piling tray 33.

Incidentally, each of the pairs of rollers 21, 23, 25, 54 includes a driving roller and a driven roller. The pair of rollers 54 is rotated through driving of a motor 57 and, at the same time, the driving rollers of the respective pairs of the rollers 21, 23, 25 are rotated through plural pulleys and belts.

Figure 4:
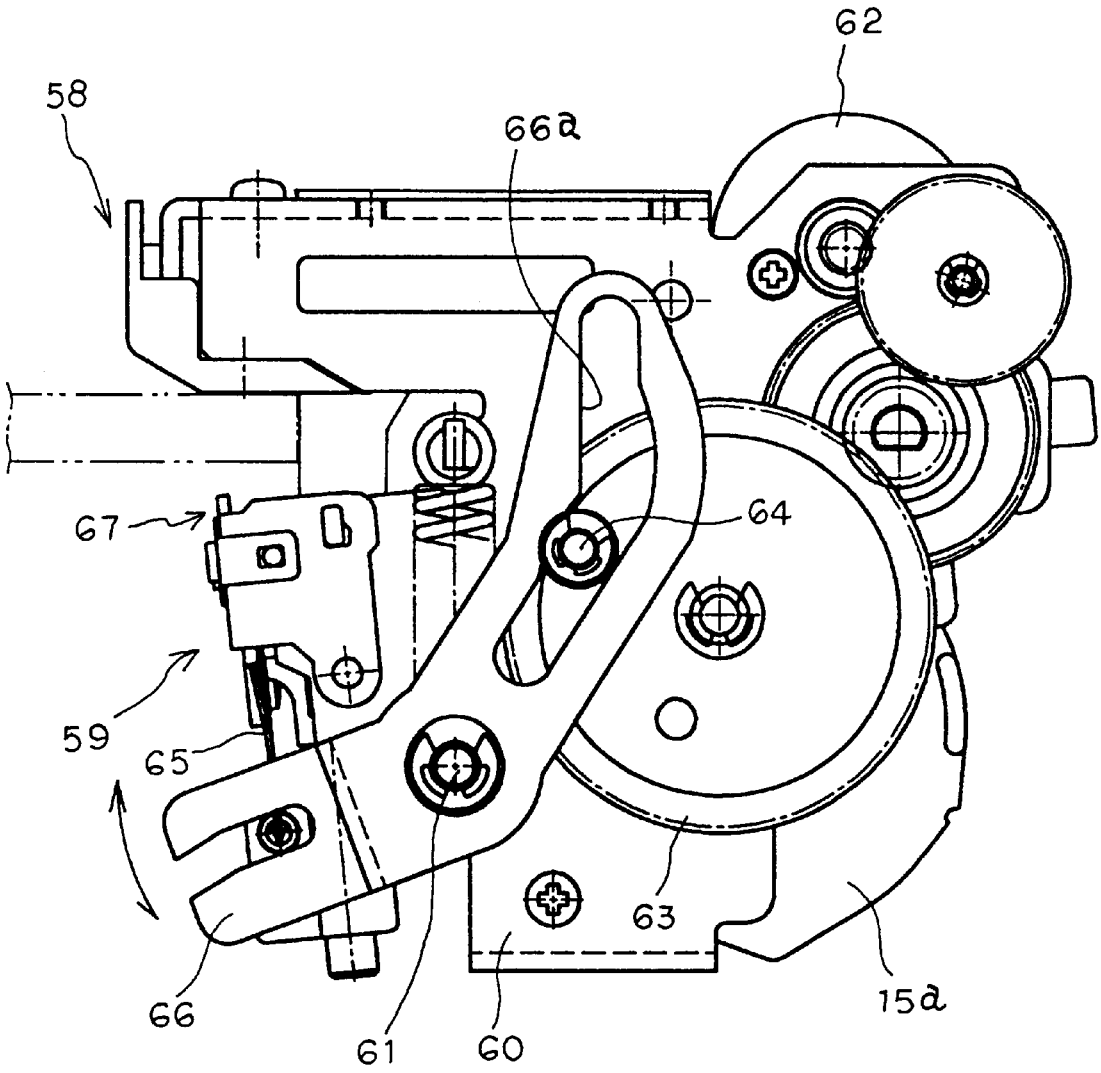
FIG. 4 is an enlarged side view of a stapling device.

The stapling device 15, as shown in FIG. 4, includes a bench unit 58 for bending a needle and a driving unit 59 for inserting the needle into sheets. A rotational center position of the driving unit 59 is fixed with respect to a bench frame 60 surrounding the bench unit 58, and the driving unit 59 is rotatably provided to a pin 61 as the rotating center. The rotating power of a driving motor 62 is transmitted to a three-step sequence gear 63.

The sequence gear 63 is provided with a projecting gear pin 64 for controlling opening and closing of the bench unit 58 by the driving unit 59.

A driver 65 for inserting, from a lower side with respect to the stack of sheets on the stapling tray 31, a needle appearing outward from a forward edge of a stapling cartridge 15*a* loaded with a plurality of needles inserts the needle into an inserting portion 67 of the driving unit 59 in association with a vertical movement of a driving arm 66. The driving arm 66 is connected to the gear pin 64 through a slot 66*a* while being rotatable around an axis, and makes one vertical movement for one rotation of the sequence gear 63.

On the other hand, the stapling device 15 is movable in a width direction of the sheet by a moving device 68 so that the sheets can be bound according to, for example, their sheet width, binding position or positions. Also, the cartridge 15*a* built in the stapling device 15 can be attached or detached by opening a back cover 14*a* (refer to arrow marks) of the housing 14, and the central portions of the guide plates 17, 18, 22 are open so that the cartridge 15*a* can be attached or detached therethrough.

Incidentally, each of the trays 31, 33, 55 is disposed with an upward inclination in at least a portion thereof so that a rear end of an ejected sheet is located at a position lower than that of a forward end thereof to thereby align the rear end by its own weight. And, although the sheet slid down by its own weight is controlled by the stopper 90 and the staple controlling wall 15*b* to thereby align the rear end thereof, since there are plural positions to be stapled, the alignment of the rear end must be properly performed under any state. Therefore, the stapling device 15 is designed as follows.

Although the stopper 90 can be rotated by a shaft, since the stopper 90 is engaged with the shaft through a coil spring, when the stopper 90 is rotated, it abuts against an upper surface of the stapling device 15, so that the coil spring is defeated to thereby stop the stopper 90. The two stoppers 90 are provided at two positions of the shaft, so that even if the stapling device 15 stops at any position, the rear end of the sheet can be supported by at least one of the two stoppers 90 and the staple controlling wall 15*b*.

In the structure as described above, in case a stack of sheets is bound by the stapling device 15, the sheet P1 ejected from the main image forming device 2 is transferred to make a detour through the second deflecting path 9, the first sheet transferring path 10 and the second sheet transferring path 11 having the deflecting portion through driving of the pairs of the transferring rollers 21, 23, 25 and guide of the guide plates 17, 18, 22, 24. At this time, the arm-type driven rollers 42 are separated from the sheet eject driving rollers 41.

And, after the rear end of the sheet to be ejected has passed through the pair of the transferring rollers 25 provided at the terminal portion of the second sheet transferring path 11 having the deflecting portion, and the forward end of the sheet ejected on the stapling tray 31 is once projected outside from a space between the sheet eject driving rollers 41 and the arm-type driven rollers 42 by a forcibly ejecting power, the sheet is guided in a reverse direction by its own weight, both edges in the width direction of the sheet abut against a pair of guides 38, 38, and the rear end of the ejected sheet abuts against the stopper 90 and the staple controlling wall 15*b* through rotation of the paddle 40 to thereby be aligned, respectively.

When the sheet detecting sensor 26 detects in a predetermined time that the sheet detecting sensor 20 counts the predetermined number of sheets; the last sheet of the counted-up sheets is transferred onto the stapling tray 31; and alignment of the sheets is completed, the paddle 40 is rotated to drop the last sheet onto the stapling device 15. Thereafter, a stack of the transfer-printed sheets is bound at the stapling device 15.

At this time, in the stapling device 15, since the transfer-printed surfaces of the sheets face the side of the stapling tray 31 (according to a situation of the sheets ejected from the main image forming device 2), the stack of sheets is stapled from a lower side thereof.

At a time point the stack of sheets is stapled, since the arm-type driven rollers 42 have already approached the sheet eject driving rollers 41 (the state as shown in FIG. 1) and gripped the stack of sheets, the stack of sheets is not collapsed by the stapling process.

Further, the stapled stack of sheets is piled on the piling tray 33 through rotation of the arm-type driven rollers 42 which have approached the sheet eject driving rollers 41 (the state as shown in FIG. 1) and gripped the stack of the sheets therewith. Thereafter, processes corresponding to the number of stacks of sheets are repeated, and as a piling quantity of the stacks of sheets increases, the piling tray 33 is moved downward to thereby allow a large number of stacks of sheets to be piled thereon.

Generally, as it is equally true in the case of the stapling device 15, the driving unit 59 for inserting the needle occupies an overwhelming volume with respect to the bench unit 58 for bending the needle. Therefore, the stapling tray 31 and stapling device 15 which can not be separated so far from the pair of transferring rollers 25 are disposed in a compact relationship, and when the sheets are substantially vertically brought into the finishing device 3 and the printed surfaces thereof face the piling side of the finishing device 3, since the needle is inserted from a lower side thereof, the path system according to the present invention is compact and optimum.

On the other hand, in case a staple binding is not carried out, the stapling device 15 is moved back to its home position to thereby rotate the levers 28, 29, and the switching lever 30 is rotated through the rotation of the levers 28, 29 to allow the second sheet ejecting path 13 to communicate with the first sheet transferring path 10.

The sheets ejected from the main image forming device 2 are transferred through the second deflecting path 9, the first sheet transferring path 10 and the second sheet ejecting path 13 by driving of the pairs of transferring rollers 21, 23, 54, and successively piled on the auxiliary piling tray 55.

As described above, in the finishing device 3 according to the present invention, since the second deflecting path 9, the first sheet transferring path 10 and the second sheet transferring path 11 having the deflecting portion are disposed to make a detour along a shape of the housing 14 so that the accommodating space 16 for accommodating the stapling device 15 therein is formed, the finishing device 3 can be made compact to be installed over the main image forming device 2. Moreover, regardless of a size of the sheet, a transferring path can be formed without difficulty. Also, the stapling device 15 does not protrude beyond the second sheet transferring path 11 having the deflecting portion so that the second sheet ejecting path 13 (the third deflecting portion) can be easily formed at a lower position.

What is claimed is:

1. A finishing device for a main image forming device, comprising:

a first sheet transferring path for guiding sheets from said main image forming device in a substantially vertical direction;

a second sheet transferring path communicated to said first sheet transferring path, said second sheet transferring path having a deflecting portion for guiding the sheets in a substantially horizontal direction;

a stapling tray extending under an exit terminal of said second sheet transferring path for temporally piling the sheets transferred from the main image forming device;

a piling tray for piling the sheets from said stapling tray disposed over the main image forming device; and a stapling device disposed between said deflecting portion of the second sheet transferring path and said stapling tray, said stapling device binding rear edges of the sheets in a sheet ejecting direction on the stapling tray.

2. A finishing device as claimed in claim 1, wherein said stapling tray is constituted by a tray device for supporting rear edge sides of the sheets in a transferring direction of the sheets transferred from said main image forming device to said piling tray.

3. A finishing device as claimed in claim 1, wherein a second deflecting portion for guiding the sheet in a direction opposite to a deflecting direction of said second sheet transferring path is formed in the first sheet transferring path under said deflecting portion, said stapling device being disposed in a substantially intermediate portion between said upper and lower deflecting portions.

4. A finishing device as claimed in claim 1, wherein at least a part of said stapling tray is inclined so that an upstream side thereof in the sheet ejecting direction is located lower than a downstream side thereof, said piling tray being inclined so that an upstream side thereof in the ejecting direction becomes lower than a downstream side thereof.

5. A finishing device as claimed in claim 1, wherein said stapling device inserts a stapling needle of a U-shape in section into the sheets piled on said stapling tray from a lower portion of a piling bottom surface of said stapling tray to bind thereof.

6. A finishing device as claimed in claim 1, wherein said piling tray is vertically movably provided to a frame of the device so that the piling tray can be lowered according to a sheet piling quantity.

7. A finishing device as claimed in claim 1, further comprising a sensor device for detecting an uppermost sheet of the sheets piled on said stapling tray, and a control device for outputting a staple prohibiting signal by detecting that a predetermined piling quantity is attained.

8. An image forming apparatus comprising:

a sheet feeding stacker for holding a sheet disposed at a bottom portion of the apparatus in a substantially horizontal direction;

a sheet feeding path for transferring the sheet from the sheet feeding stacker in a substantially vertical direction by deflecting the sheet in a direction substantially perpendicular thereto;

an image forming device for forming an image on the sheet transferred from said sheet feeding stacker and being located in the sheet feeding path;

a first sheet transferring path for guiding the sheet from the image forming device in a substantially vertical direction;

a deflecting portion formed in the first sheet transferring path, said deflecting portion deflecting the sheet in a substantially horizontal direction;

a stapling tray for temporally stacking the sheet transferred from the image forming device through the defecting portion;

a stacking tray situated near the stapling tray for stacking a stack of the sheets from the stapling tray; and a stapling device disposed between the first sheet transferring path and the stapling tray for binding the sheets on said stapling tray.

9. An image forming apparatus as claimed in claim 8, further comprising a third deflecting portion provided to the first transferring path, said third deflecting portion deflecting the sheet through a path switching device in the substantially horizontal direction, and a sheet holding tray different from said piling tray extending from the third deflecting portion.

* * * * *